United States Patent [19]

Bujan

[11] 4,187,893

[45] Feb. 12, 1980

[54] COMBINED ADDITIVE AND ADMINISTRATION PORT FOR A CONTAINER

[75] Inventor: Albert F. Bujan, Waukegan, Ill.

[73] Assignee: Abbott Laboratories, North Chicago, Ill.

[21] Appl. No.: 925,919

[22] Filed: Jul. 19, 1978

[51] Int. Cl.[2] ..... B65D 33/16

[52] U.S. Cl. ..... 150/8; 215/247

[58] Field of Search ..... 150/8; 215/247, 248, 215/249; 128/214 D, 272, 272.3

[56] References Cited

U.S. PATENT DOCUMENTS

| | | | |
|---|---|---|---|
| 2,876,775 | 3/1959 | Barr | 215/247 X |
| 2,911,123 | 11/1959 | Saccomanno | 215/247 |
| 3,915,212 | 10/1975 | Bujan et al. | 150/8 |

*Primary Examiner*—Donald F. Norton

*Attorney, Agent, or Firm*—Robert L. Niblack; Neil E. Hamilton

[57] ABSTRACT

A single port is provided for a container such as an I.V. bag which can serve both as an additive port and also as an administration port. The combined administration and additive port has an inner diaphragm portion which is in open communication with the solution in the container and an outer resealable stopper unit which when pierced by a needle of a hypodermic syringe is self-sealing. The outer resealable unit is removable from the port so that the port subsequently serves as the usual administration port when utilizing the standard I.V. administration equipment.

22 Claims, 10 Drawing Figures

COMBINED ADDITIVE AND ADMINISTRATION PORT FOR A CONTAINER

BACKGROUND OF THE INVENTION

Double closure-type caps are disclosed in U.S. Pat. Nos. 2,824,661; 3,239,112; 3,278,063 and 3,556,331. In U.S. Pat. No. 2,824,661 a double closure system is disclosed for a pressurized bottle whereas in U.S. Pat. No. 3,239,112 an inner diaphragm member is described for a double closure cap system wherein the inner diaphragm member is removable. In U.S. Pat. No. 3,278,063 an outer sealing member is used in combination with an inner cap arrangement and in U.S. Pat. No. 3,556,331 a hinged-type cover is provided for a container closure. The prior art is concerned with a double port system in an I.V. solution bag and does not provide a double closure cap system for a container such as a flexible I.V. bag wherein a single port can serve as both an additive and administration port and the outer closure member is both resealable and removable.

In the fabrication of plastic bags for I.V. solutions, it is important that the solution be maintained in a sterile condition and that the solution contact a minimum number of different materials. This latter requirement is for the purpose of reducing the problem of extractables.

It is an advantage of the present invention to afford a single access port for a container which can serve as both a means for adding ingredients to the container as well as a means for administering the contents. Other advantages are a sterile port for a blood bag or an I.V. solution container which will maintain the contents of the bag in a sterile condition and reduce undesired extractables; a combined port site which is readily sealable to a flexible I.V. solution container; a double closure system for sterile solutions wherein the outer closure member is readily removable; and a combined additive and administration port for a container which can be assembled in a fast and economical manner.

SUMMARY OF THE INVENTION

The foregoing advantages are accomplished and the shortcomings of the prior art are overcome by the present combined additive and administration port wherein a tubular walled port is in communication with the inside of the container and the container is sealed to outside atmosphere by means of an inner diaphragm member forming a portion of the port. An outer resealable member is removably secured to the port and positioned from the diaphragm member in a direction opposite the inside of the container. A tab portion is operatively connected to the resealable member for removing the resealable member from the port. In a preferred manner, the port further includes an inner guide member defining a tubular wall and passageway, with the inner diaphragm member sealing the passageway. Further, the resealable member is preferably formed by a reseal button which is interconnected to a port cover and is removed with a portion of the port cover by means of a preweakened groove in the port cover. The purpose of the outer resealable member is to permit the needle of a hypodermic syringe to pass through the resealable unit as well as through the diaphragm so that the contents of the syringe can be delivered to the inside of the container. Upon withdrawal of the syringe the port will be resealed and upon administration, the outer resealable member is readily removable so as to permit a cannula member to penetrate through the inner diaphragm portion.

DESCRIPTION OF THE DRAWING

A better understanding of the present combined additive and administration port for a container will be accomplished by reference to the drawings wherein.

DESCRIPTION OF THE PREFERRED EMBODIMENT

Figure 1:
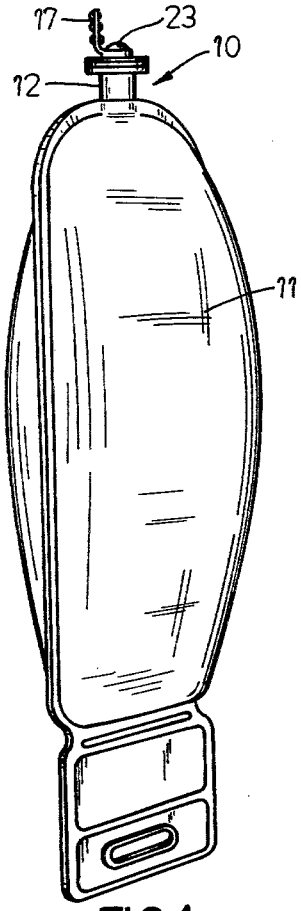
FIG. 1 is a perspective view of the combined port of this invention shown in conjunction with a flexible I.V. bag shown upside down.
Figure 2:
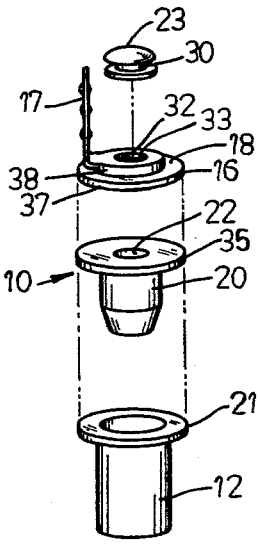
FIG. 2 is an assembly view of the combined administration and additive port.

Proceeding to a detailed description of the present invention, the combined additive and administration port generally 10 is shown in FIG. 1 in conjunction with a resinous plastic, flexible, I.V. bag 11 with the bag unit being shown in an upside-down position. As best seen in FIG. 2, the port 10 is composed of a tubular walled member 12 having an end wall or flange 21. An inner tubular guide member 20 will seat in a telescoping manner within the tubular wall member 12 with the annular flange 35 of the inner guide member 20 resting against flange or end wall 21 of tubular member 12. Positioned over the inner guide member 20 is an outer resealable and pierceable member 16 and 23 having a tab portion 17 as well as a large diameter section 37 for seating on flange 35. A reseal button 23 having a groove 30 is separately receivable in the inner diameter portion 32 or annulus of passage 33 and the small diameter section 38 of cover 18.

Figure 3:
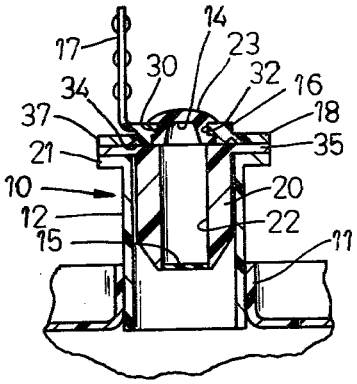
FIG. 3 is a view in vertical section of the port shown in FIGS. 1 and 2.

Referring specifically to FIG. 3, it will be seen that the tubular wall member 12 is sealed to a portion of bag 11 in the usual manner. Inner guide member 20 is secured to a tubular wall member 12 by means of annular flange 35 secured against flange 21 of wall member 12 and has a pierceable inner diaphragm 15 sealing passageway 22 of guide member 20. Positioned over guide member flange 35 is large diameter section 37 of port cover 18 with reseal button 23 being axially aligned with inner guide member 20 and tubular wall member 12. It will be seen that button 23 has a groove 30 which is accommodated by an inner diameter portion 32 of port cover 18 to retentively secure the button 23 to the port cover 18. Button 23 also has an inner hollow compartment 14 to aid in piercing through the reseal unit.

Figure 4:
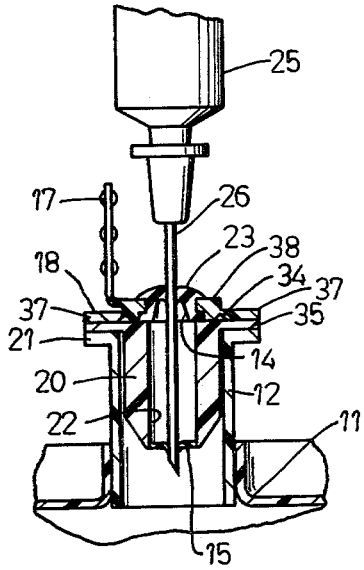
FIG. 4 is a view similar to FIG. 3 except showing penetration by the needle of the hypodermic syringe.
Figure 5:
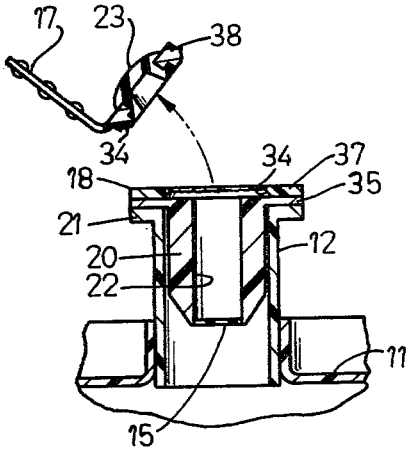
FIG. 5 is a view of the port shown in the previous FIGURES and in vertical section showing the reseal button member torn away from the port.

Referring specifically to FIGS. 3 and 4, it will be noted that the port cover 18 is provided with a preweakened groove 34 positioned adjacent the termination of small dimensional section 38 on large dimensional section 37 which will permit the intentional tearing away of a portion of the port cover as represented by the small diameter section 38. This latter aspect is shown in FIG. 5.

FIGS. 6, 7, 8, 9 and 10 represent alternative embodiments. Similar numbers are employed to indicate similar parts in the previous embodiment 10, as well as in the alternative embodiments, except that they are shown in the "100", "200", "300", "400" and "500" series. Only those components or features which differ from those previously mentioned with respect to port unit 10 will be described except for certain similarities. The I.V. solution bag 11, as well as the corresponding bags shown in the alternative embodiments, is of the type described in U.S. Pat. No. 3,915,212 entitled "Flexible Medical Fluid Container Having a Combined Fill and Administration Port and Reinforced Hanger" and is commonly assigned.

Figure 6:
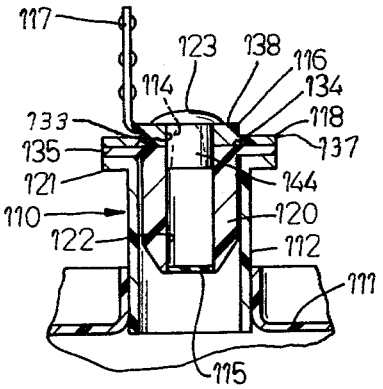
FIG. 6 is a view in vertical section of an alternative embodiment of the invention.

The FIG. 6 embodiment 110 differs from that previously described in that in place of a groove such as 30 and inner diameter portion 32 securing the reseal button 123 to the port cover 118, an annular insert or extension 144 is utilized. In this manner, the insert is merely heat sealed or adhesively secured to the inside portions of the inner guide member 120 and along guide passageway 122 as well as to the central passage 133 of port cover 118.

Figure 7:
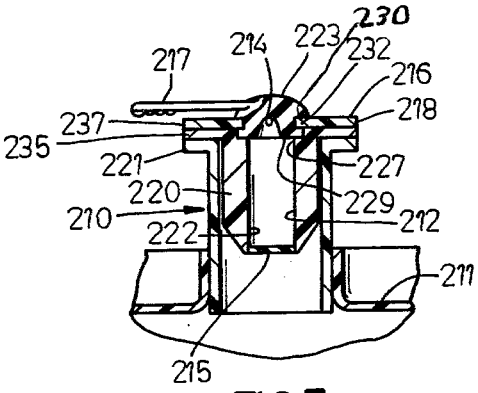
FIG. 7 is a view similar to FIG. 6 showing another alternative embodiment.

The FIG. 7 unit 210 distinguishes from embodiment 10 in that the tab or handle portion 217 is directly secured to the reseal button 223 rather than the port cover 218. It will be seen that reseal button 223 is secured to port cover 218 by means of annular groove 230 accommodated by an inner diameter portion 232 defining a central passage in cover 218. Further, in this embodiment, the inner guide member 220 has a cutaway shoulder 227 for resting against the base portion 229 of reseal button 223. In this embodiment, as in embodiment 310, sections 237 and 337 do not have smaller diameter portions but correspond to sections 37 and 137 in all other respects in forming closed end walls.

Figure 8:
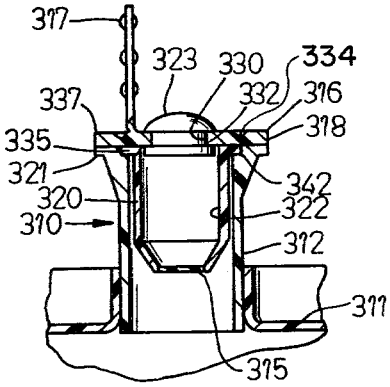
FIG. 8 is a view in vertical section of still another embodiment of the present port member.

FIG. 8 represents another means for securing the inner guide member 320 to the tubular wall port 312. In this embodiment 310, the annular flange 335 of the inner guide member 320 rests on an inner ledge portion 342 of the tubular wall member 312. It will be seen that this embodiment 310 as in embodiment 210 and 10 that the groove 330 is utilized in the reseal button 323 for securing the reseal button to the port cover 318 and that the tab portion 317 is directly attached to the port cover 318.

Figure 9:
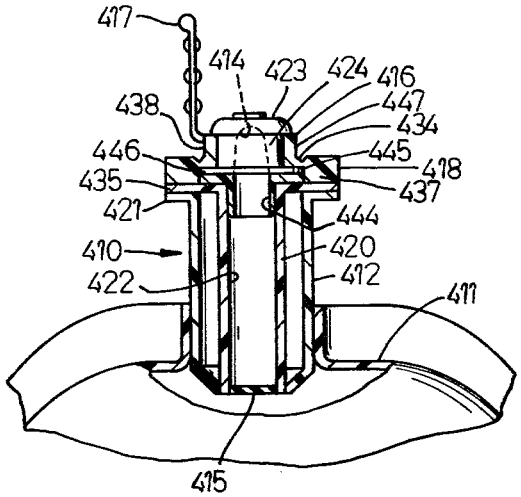
FIG. 9 is a view in partial vertical section showing yet another alternative structure.

In embodiment 410, shown in FIG. 9, the port cover 418 has an extension or insert portion 444 which fits into the guide passageway 422 and is secured therein. The port cover 418 also has an annular slot 446 for accommodating a hollow disc 445 upon which is seated the reseal button 423. Reseal button will not only rest against the disc member 445 but will be secured in a central passage of cover 418 formed by means of the upstanding wall portion 447 of port cover 418 which will accommodate the smaller inner diameter portion 424 of reseal button 423.

Figure 10:
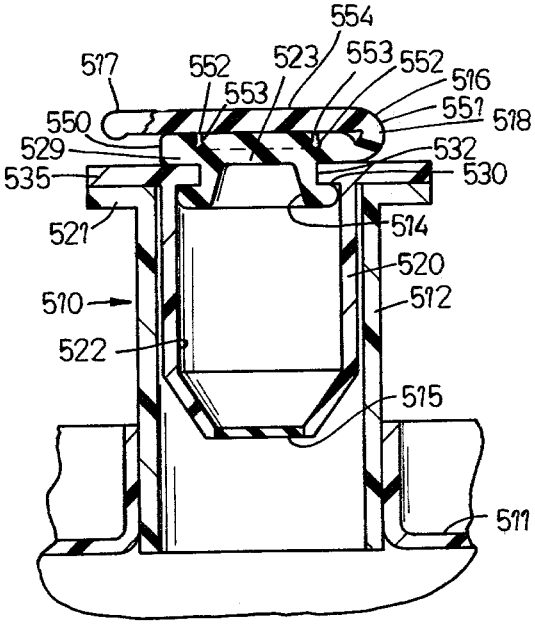
FIG. 10 is a view similar to the previous FIGS. 6–9 showing still another alternative unit.

The embodiment 510 as shown in FIG. 10, illustrates a reseal button arrangement 523 which has a cover portion 554 secured to a base portion 550 by means of a hinging section 551. Projections 552 extend from cover 554 and are accommodated in locking slots 553.

OPERATION

A better understanding of the advantages of the combined additive and administration units 10, 110, 210, 310, 410 and 510 will be had by a description of their fabrication and operation. As all of the units will be utilized in essentially the same manner only unit 10 will be referred to specifically with reference being made to the other units in the manner in which they differ. Combined port unit 10 will be assembled as shown in FIG. 2 with the reseal button 23 being snap fitted into the central passage 33 of port cover 18 by means of groove 30 being fitted into inner diameter portion 32. With the components assembled in the manner indicated in FIG. 3, and the tubular wall member 12 positioned along an open edge of bag 11 all of the components will be heat sealed together as well as the tubular wall member 12 heat sealed to the bag. When it is desired to effect the addition of an additive component to the contents of bag 11, a hypodermic syringe 25 with a hypodermic needle 26 will be utilized. The needle 26 will be axially aligned with compartment 14 of button 23 and the guide passageway 22. It will pierce through the reseal button 23 as well as the inner diaphragm 15 as best shown in FIG. 4. The contents of the syringe 25 will then be delivered to the inside of the bag and the needle 26 withdrawn. Upon withdrawal, the contents of the bag will be sealed against outside atmosphere by the resealability of the reseal button 23. When it is desired to administer the contents of the bag 11, the reseal button will be removed from the port cover 18 by grasping the tab portion 17 and pulling away from the bag. Preweakened groove 34 will facilitate the tearing of cover 18 and removal of the reseal button in that it is placed on the underside of the port cover 18 and adjacent the juncture of the small diameter portion 38 with the large diameter portion 37. As will be seen in FIG. 5, the tearing will be effected so that the small diameter portion 38 is carried away with the reseal button 23. An I.V. administration apparatus will then be connected to bag 11 by means of the usual piercing cannula inserted into guide passageway 22 and piercing through diaphragm 15 to provide communication with the contents of the bag 11.

The operation of the unit shown in FIGS. 6, 7, 8 and 9 as units 110, 210, 310 and 410 is basically the same as previously described for unit 10. Only the fabrication of these units differ. For example, in port unit 110 the reseal button 123 with insert 144 will have applied an adhesive so that it is readily secured in passageway 122 of guide 120. In unit 210, button 223 of unit 210 will have the added security of the base 229 seated against the cutaway shoulder 227 and if desired an adhesive could be applied in this particular area. The same remarks pertain to the placement of annular flange 335 of guide 320 in wall 312 of unit 310 and the seating of insert 444 of unit 410 in passageway 422 as well as the placement of disc 445 in slot 446 and the seating of small diameter portion 424 against the upstanding wall 447 of port cover 418.

Unit 510 described in FIG. 10 offers an added advantage in that when the cover 554 is lifted away from base portion 529 and the projections 552 forced from locking slots 553, the cover portion can be replaced over the reseal site once the syringe is withdrawn as an added sterility precaution. By means of the groove 530 seated in inner diameter portion 532 of guide 520, the reseal button can be forcibly removed by means of handle 517 to expose the inner diaphragm 515 for subsequent piercing by an I.V. adminstration set piercing pin. The same mechanism for removal would pertain to unit 210 and the removal of button 223.

In the foregoing embodiments, the tubular wall members such as 12 as well as the inner guide members such as 20 with diaphragm 15 and the port covers such as 18 are composed of a resinous plastic material such as polyvinylchloride, polyurethane, copolymers and the like. The reseal buttons such as 23 are fabricated from a rubber material such as natural rubber, synthetics or applicable copolymers. The bag units of which 10 is representative are molded from a flexible polyvinylchloride. However, other resinous flexible or semirigid plastic materials could be utilized such as any injection or compression moldable plastic, to manufacture the bags as well as the tubular wall members, the inner guide members and the port covers. Preferably the ports, the inner diaphragm and the container walls will be formed of the same plastic materials and of a thermoplastic material. Further, and if desired, the combined administration and additive ports of this invention could be utilized with a glass container.

It will thus be seen that through the present invention there is now provided a unitary administration and additive port which will prevent the contact of the contents of the container with the rubber reseal unit. This is important when I.V. solutions are involved in that rubber materials are known to have high extractables. Accordingly, the contents of the container are prevented from contacting the rubber reseal unit yet at the same time the reseal unit serves to prevent contamination of the inside of the container once the delivery needle is withdrawn from the inner pierced diaphragm. Further, the reseal component is easily removed from the combined ports of this invention by an easy tear or pop-out feature. By providing a combined administration and additive port in an I.V. bag container considerable cost savings are effected in that only one port need be fabricated and secured to a container.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. A combined additive and administration port for a container for I.V. liquids comprising:

a tubular walled port in communication with the inside of said container;

an inner diaphragm member forming a portion of said port and sealing the inside of said container to outside atmosphere;

an outer resealable and pierceable member removably secured to said port and positioned from said diaphragm member in a direction opposite the inside of said container; and a tab portion operatively associated with said resealable member for removing said resealable member from said port separately from said diaphragm member.

2. The combined additive and administration port as defined in claim 1 wherein said port further includes an inner guide member defining a tubular wall and passageway and said inner diaphragm member seals said passageway.

3. The combined additive and administration port as defined in claim 2 wherein said guide member is supported in said tubular walled port by means of an annular flange.

4. The combined additive and administration port as defined in claim 3 wherein said tubular walled port is defined by an annular flange positioned outside the confines of said container, said annular flange of said guide member is positioned over said annular flange of said tubular walled port and said outer resealable member is secured in part to the annular flange of said guide member.

5. The combined additive and administration port as defined in claim 4 wherein said resealable member includes a cover and said cover is defined by a larger and a small dimensional section, said cover being preweakened adjacent the termination of said smaller dimensional section.

6. The combined additive and administration port as defined in claim 5 wherein said tab portion is secured to said smaller dimensional section.

7. The combined additive and administration port as defined in claim 3 wherein said guide member defines an inner shoulder surface and a portion of said resealable member contacts said shoulder surface.

8. The combined additive and administration port as defined in claim 3 wherein said tubular walled port defines a ledge surface and said annular flange of said guide member contacts said ledge surface.

9. The combined additive and administration port as defined in claim 2 wherein said outer resealable member is defined by a base portion for attachment to said inner guide member and includes a cover portion hinged to said base portion.

10. The combined additive and administration port as defined in claim 9 further including means to releasably secure said cover portion to said base.

11. The combined additive and administration port as defined in claim 1 wherein said tubular walled port includes an end wall placed outside the comfines of said container and said outer resealable member is secured to said end wall at a side opposite said container.

12. The combined additive and administration port as defined in claim 11 wherein said outer resealable member includes a reseal button.

13. The combined additive and administration port as defined in claim 12 wherein said reseal button is mechanically secured to said tubular walled port.

14. The combined additive and administration port as defined in claim 13 wherein said resealable member includes a port cover and said tubular walled port is sealed in part by said port cover and said reseal button is secured to said cover.

15. The combined additive and administration port as defined in claim 14 wherein said tab portion is directly attached to said reseal button.

16. The combined additive and administration port as defined in claim 14 wherein said tab portion is directly attached to said port cover.

17. The combined additive and administration port as defined in claim 14 wherein said reseal button is secured in said cover by means of a groove in said reseal button and a complementary annulus in said cover.

18. The combined additive and administration port as defined in claim 14 wherein said cover includes a preweakened portion for removal from said tubular walled port.

19. A unitary additive and administration port for a container having flexible wall portions adapted to receive a sterile intravenous liquid comprising:

a semirigid tubular walled port in communication with the inside of said container and sealed to said flexible wall portions;

an inner diaphragm member forming a portion of said port and sealing the inside of said container to outside atmosphere;

said tubular walled port and said diaphragm member composed of the same material as said flexible wall portions of said container;

an outer resealable and pierceable member removably secured to said port and positioned from said diaphragm member in a direction opposite the inside of said container; and a handle portion operatively connected to said resealable member for removing said resealable member from said port.

20. The combined additive and administration port as defined in claim 19 wherein said flexible wall portion of said container, said tubular walled port and said diaphragm member are composed of a thermoplastic material and said resealable member includes a reseal button composed of a rubber containing material.

21. The combined additive and administration port as defined in claim 19 further including an inner guide member defining a tubular wall and central passageway and said inner diaphragm member seals said passageway.

22. The combined additive and administration port as defined in claim 21 wherein said resealable member includes a port cover, said inner guide member and said port cover being sealed as one integral component with said port cover having preweakened portions for forceable removal.

* * * * *